US006321838B1

(12) United States Patent
Skinner

(10) Patent No.: US 6,321,838 B1
(45) Date of Patent: Nov. 27, 2001

(54) APPARATUS AND METHODS FOR ACOUSTIC SIGNALING IN SUBTERRANEAN WELLS

(75) Inventor: Neal G. Skinner, Lewisville, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/572,768

(22) Filed: May 17, 2000

(51) Int. Cl.[7] ..... E21B 47/00; G01V 1/06
(52) U.S. Cl. ..... 166/250.01; 166/63; 181/117
(58) Field of Search ..... 166/244.1, 254.1, 166/281, 297, 298, 250.01, 65.1, 63; 181/105, 106, 117

(56) References Cited

U.S. PATENT DOCUMENTS

| | | | | |
|---|---|---|---|---|
| 3,900,827 | * | 8/1975 | Lamel et al. | 367/82 |
| 4,293,936 | * | 10/1981 | Cox et al. | 367/82 |
| 5,293,937 | * | 3/1994 | Schultz et al. | 166/250.01 |
| 5,443,119 | * | 8/1995 | Chambers et al. | 166/254.2 |

OTHER PUBLICATIONS

U.S. Patent application Ser. No. 09/056,053, filed Apr. 6, 1998.
U.S. Patent application Ser. No. 09/056,055, filed Apr. 6, 1998.

Copy of Kinsler, L. E., Frey, A. R. Coppens, A. B. and Sanders, J. V. *Fundamenttals of Acoustics*, John Wiley & Sons, Inc., 1982, pp. 239–241.

Copy of Mauer, W. C., MacDonald, W. J., Shoemaker, H. D., Dareing, D. W., "Mud Pulse Tachometer For Downhole Drilling Motors", 81–pet–3, Presented at the ASME Energy Sources Technology Conference and Exhibition, Jan. 18–22, 1981, Houston, Texas.

Copy of Patton, B. J., Gravely, J. K., Sexton, J. H., Hawk, D. E., Slover, V. R., Harrell, J. W., "Development and Successful Testing of A Continuous–Wave, Logging–While–Drilling Telemetry System", *Journal of Petroleum Technology*, Oct., 1977, p. 1215–1221.

* cited by examiner

*Primary Examiner*—Frank Tsay
(74) *Attorney, Agent, or Firm*—Paul I. Herman; Todd E. Albanesi

(57) ABSTRACT

Disclosed are new apparatus and methods for transmitting and enhancing the propagation of acoustic signals through a well tubing while providing a vent port. The apparatus and methods can be used to control subsurface well tools without wire or line connections to the surface.

20 Claims, 2 Drawing Sheets

APPARATUS AND METHODS FOR ACOUSTIC SIGNALING IN SUBTERRANEAN WELLS

TECHNICAL FIELD

The present inventions relate to improvements in apparatus and methods used to transmit acoustic signals in subterranean wells. More particularly the present inventions relate to improved apparatus and methods for transmitting an acoustic pulse downhole and reducing the attenuation of the acoustic pulse.

BACKGROUND OF THE INVENTIONS

Acoustic signals, broadly defined, are mechanical waves that can travel through a fluid or solid. An acoustic pulse can be described in terms of the sum of superimposed sinusoidal waves of appropriate frequencies and amplitudes. Acoustic pulses may consist of low frequency or high frequency components or a combination of both.

It is known to use acoustic systems and methods for performing operations in a gas or oil well. Generally, acoustically controlled working apparatus is deployed downhole and acoustic pulses are transmitted into the well. An acoustic pulse can be sent down a fluid filled tube to remotely control a downhole device designed to respond to an acoustic pulse or predetermined series of pulses. One of the problems with transmitting acoustic signals downhole is the attenuation of the acoustic signal. Acoustic signals transmitted into a well tend to decay exponentially with distance, making the use of such systems particularly difficult with increased depth. One method of attempting to overcome the attenuation problem is the use of acoustic repeaters. The repeaters must be spaced at various depths along the well, creating problems of cost and complexity.

Because of the above problems, there is a need for improved apparatus methods of transmitting acoustic pulses downhole in a subterranean well.

SUMMARY OF THE INVENTIONS

The disclosed apparatus and methods for enhancing the propagation of acoustic signals through well tubing makes use of a vent port in the tubing wall between the source of an acoustic pulse and the intended receiver. In general, the vent port has an open chamber to vent excess pressure while retaining the desired frequency components of the acoustic pulse. The vent port and chamber are proportioned relative to one another and to the well tubing diameter to perform the venting function without dramatically attenuating the desired low frequency components of the acoustic pulse.

According to one embodiment of the apparatus and methods, the invention transmits acoustic signals downhole through well tubing with a compressed gas gun.

According to another embodiment of the apparatus and methods of the invention acoustic pulse transmissions from a compressed gas gun are used to control one or more downhole tools.

BRIEF DESCRIPTION OF THE DRAWINGS

The accompanying drawings are incorporated into and form a part of the specification to illustrate several examples of the present inventions. These drawings together with the description serve to explain the principals of the inventions. The drawings are only for the purpose of illustrating preferred and alternative examples of how the inventions can be made and used and are not to be construed as limiting the inventions to only the illustrated and described examples. The various advantages and features of the present inventions will be apparent from a consideration of the drawings in which.

DETAILED DESCRIPTION

Figure 1:
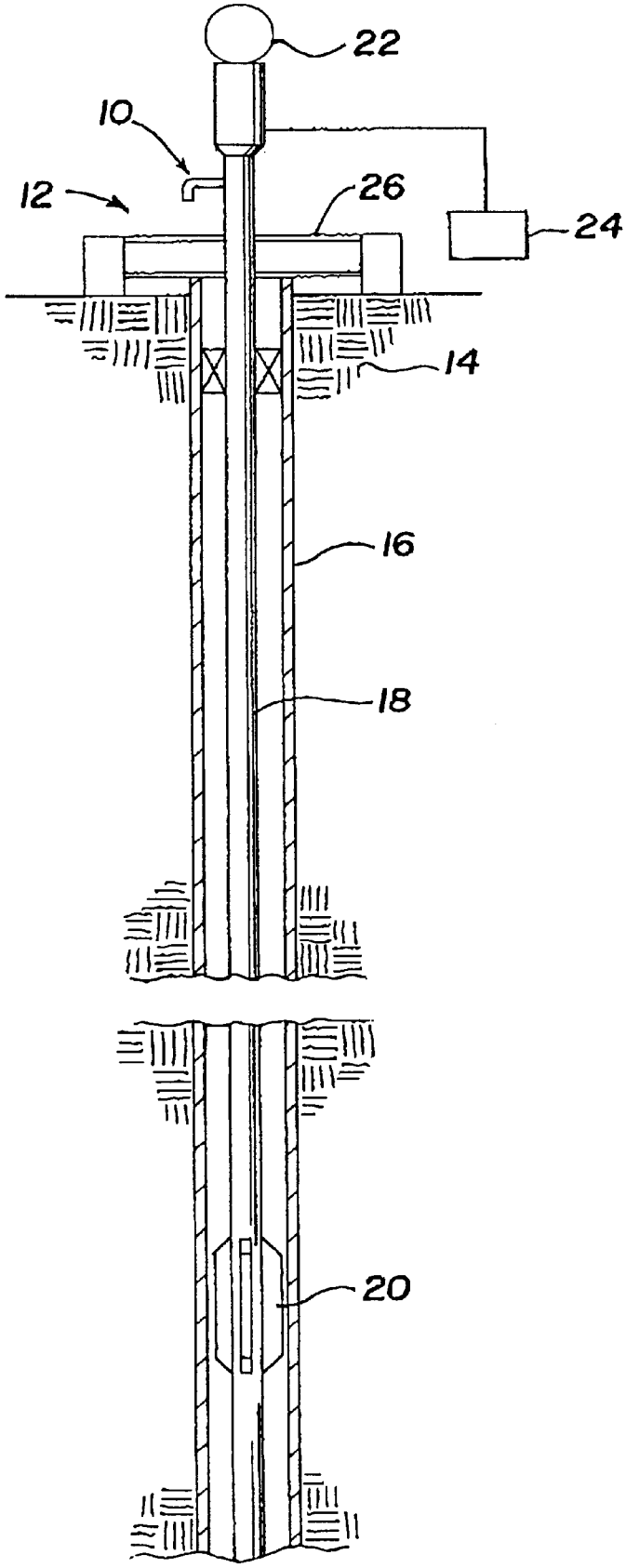
FIG. 1 is a side sectional view illustrating an embodiment of the apparatus or acoustic signaling in a cased well.

The present inventions are described by reference to drawings showing one or more examples of how the inventions can be made and used. In these drawings, reference characters are used throughout the several views to indicate like or corresponding parts.

In general, the invention uses a compressed gas gun and control circuitry to generate acoustic pulses for transmission at timed intervals downhole in a well. The use of a compressed gas gun to transmit acoustic pulses downhole carries with it the added problem of the need to vent the resulting increased gas pressure from the well. A relatively small orifice is made in the side wall of the well tubing downhole from the compressed gas gun in order to allow excess gas pressure to escape during the time intervals between pulses. The use of an orifice in the tubing wall creates an additional problem of its own by increasing the attenuation of the pulse. In general, the lower frequency components of the pulse are more attenuated by an orifice in the side of the tubing than the higher frequency components, creating a high pass filter effect. This is a particularly significant problem because the lower frequency components of the acoustic pulse are less attenuated by distance than the higher frequency components, making the lower frequency components particularly desirable for transmission downhole. Conversely, the high frequency components of the pulse are relatively unaffected by the orifice, but suffer greater attenuation over distance. Increasing the radius of the orifice tends to cause an increase in the attenuation of low frequencies. Decreasing the radius of the orifice correspondingly decreases the attenuation of low frequencies, but any such decreases in the radius of the orifice are inherently limited by the need to provide an effective vent in the well tubing.

FIG. 1 generally depicts a vent port 10 for enhancing acoustic signaling in use with a typical subterranean well such as an oil or gas well. The well 12 is bored into the earth 14 and lined with a well casing 16. Well tubing 18 is deployed within the casing, and at least one subterranean tool 20 is in turn deployed in the tubing 18. One or more subterranean tools are equipped to be controlled by acoustic signals transmitted through the well tubing. Typically, an acoustic transmitter, in this example a compressed gas gun 22, is operably connected to a control circuit 24 above the well head 26. It is anticipated that the present inventions and methods could be used to enhance acoustic signals used to manipulate any and all acoustically controlled downhole well tools using compressed gas pulses.

Figure 2:
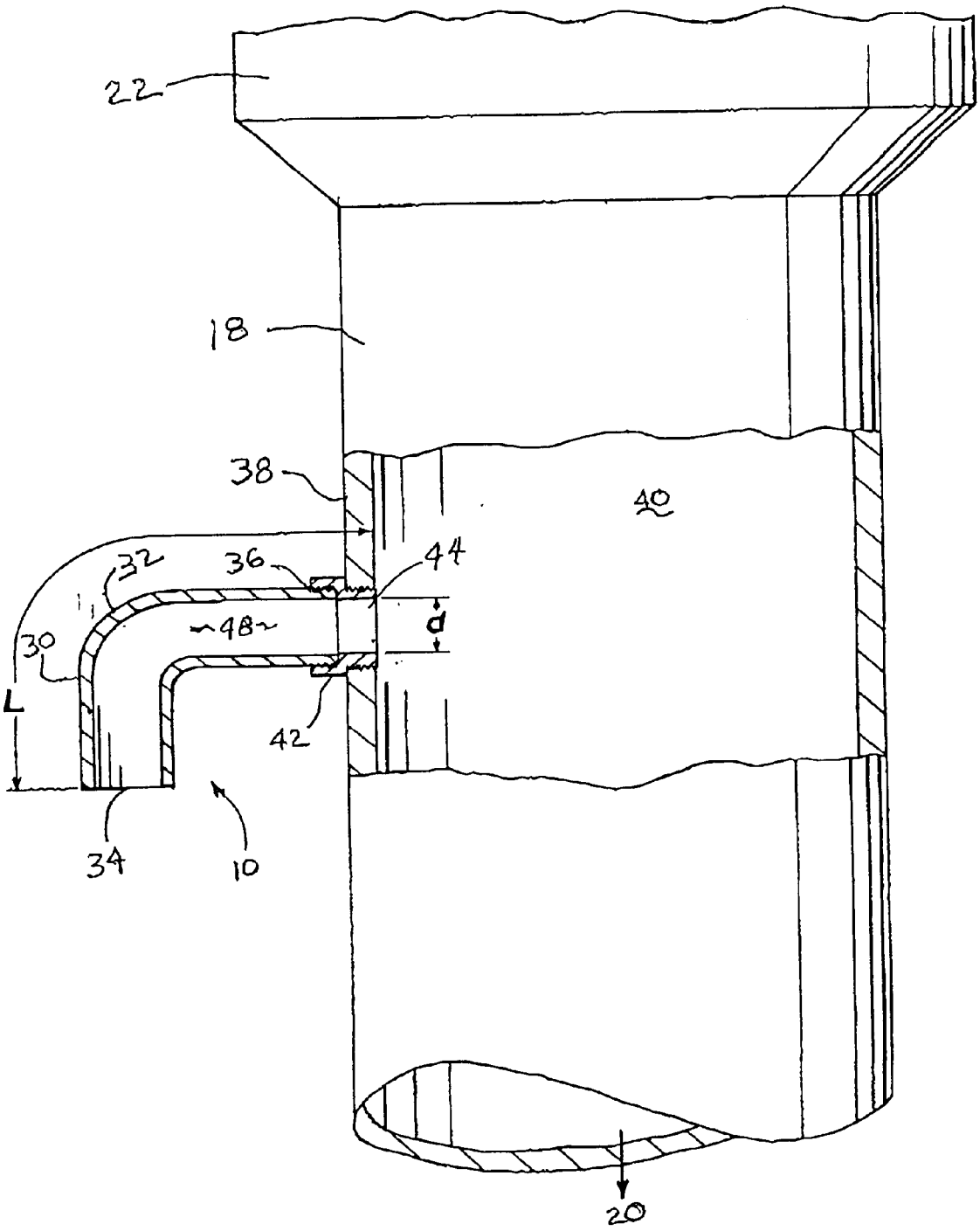
FIG. 2 is a sectional side view illustrating the acoustic signaling apparatus of FIG. 1.

Referring to FIG. 2, the vent port 10 of FIG. 1 is shown installed on well tubing 18. It should be understood that the vent port is located between the acoustic source and the acoustic receiver. The acoustic source shown in this example is a compressed gas gun 22 but may be any compressed gas pulse transmitter. The vent port 10 is made from a length of pipe 30, preferably metal, although other rigid materials may be used. The vent port preferably has a bend 32 of approximately 90 degrees, but may be bent at other angles or curves, or may include multiple bends or no bends. The pipe 30 has.

an exhaust end 34, preferably oriented parallel to the downhole direction, and an inlet end 36. The inlet end 36 adjoins the wall 38 of the well tubing and is acoustically coupled to the interior 40 of the tubing, preferably with a metal pipe nipple 42 or other fitting. The vent port may also be welded to the well tubing or attached in any other acoustically sealing manner.

If properly described, the vent port dramatically decreases the attenuation of the low frequency components of the acoustic signal. In effect, moving the cutoff frequency of the high pass filter to a much lower frequency. The result is that more low frequency components of the pulse are more effectively transmitted downhole.

The threaded nipple 42 shown in FIG. 2 is attached and acoustically coupled to the tubing 18 by means of a correspondingly threaded orifice 44 in the tubing wall 38. The orifice 44 is smaller in diameter than the inside diameter of the tubing 18. The threaded nipple 42 is in turn threaded to the inlet end 36 of the pipe 30. Of course any acoustically sealing connection may be used.

The interior volume surrounded by the nipple 42, and pipe 30 of the vent port define a chamber 48. It will be readily apparent that in cases where no nipple is used, the chamber 48 will be defined by the interior volume surrounded by tubing wall about the orifice 44, and the pipe 30. The dimensions of the chamber 48 determine the acoustic properties of the vent port 10. It is believed that in general, when the minimum inside diameters of the well tubing 18 and chamber 48 are small relative to the wavelength of the acoustic pulse, the power of an acoustic signal transmitted downhole past the chamber 48 is given by the formula:

$$T = \frac{1}{1 + \left(\frac{cd^2}{4\pi D^2 (L + .75\,d) f}\right)^2}.$$

T=fraction of acoustic power transmitted downhole;

c=acoustic velocity in the medium (feet/second);

f=frequency (Herz);

D=minimum inside diameter of well tubing (feet);

d=minimum inside diameter of chamber (feet);

L=length of chamber (feet).

It should be understood that the inside diameter that is taken into account in the above formula is the inside diameter of the chamber 48, which is often defined by the orifice or nipple used to acoustically couple the pipe 30 to the well tubing 18. In the preferred embodiment, the inside diameter of the chamber 48 is uniform and equal to the inside diameter of the corresponding nipple 42. It is believed that generally the inside diameter of the chamber 48 should be equal to or greater than the inside diameter of the nipple, or of the orifice if no nipple is used.

It should also be understood by those conversant with the art, that in general, the inside diameter of the well tubing (D) is known. The velocity that can be anticipated for an acoustic pulse (c) in a particular medium, usually air, is generally known in the art. The frequency (f) and power (T) required by the intended receiver of the acoustic pulse is also typically known based on the characteristics of the equipment placed downhole. The length (L) and diameter (d) of the chamber 48 can then be determined. Generally, the operator can select either a length (L) or diameter (d) and compute the other dimension based on the available materials or other convenience factors. Accordingly, the invention can be practiced by determining the dimensions of the chamber by the solution to either of the equations:

$$L = \sqrt{\frac{T}{1-T}}\,\frac{cd^2}{4\pi D^2 f} - .75\,d.$$

$$d = \frac{D}{2c}\sqrt{\frac{1-T}{T}}\left[3\pi Df + \sqrt{\pi f\left(9D^2\pi f + \frac{16Lc}{\sqrt{\frac{1-T}{T}}}\right)}\right].$$

The embodiments shown and described above are only exemplary. Many details are often found in the art such as for example variations in: pipe, tubing, and connector materials; methods for joining pipe and tubing; acoustic transmitters. Therefore, many such details are neither shown nor described. It is not claimed that all of the detail parts, elements, or steps described and shown were invented herein. Even though numerous characteristics and advantages of the present inventions have been set forth in the foregoing description, together with details of the structure and function of the inventions, the disclosure is illustrative only, and changes may be made in the detail, especially in matters of shape, size and arrangement of the parts within the principles of the inventions to the full extent indicated by the broad general meaning of the terms used the attached claims.

The restrictive description and drawings of the specific examples above do not point out what an infringement of this patent would be, but are to provide at least one explanation of how to make and use the inventions. The limits of the inventions and the bounds of the patent protection are measured by and defined in the following claims.

What is claimed is:

1. A device for enhancing the propagation of acoustic signals through a well tubing comprising:

a chamber having an inlet end acoustically coupled to the interior of the well tubing and an exhaust end outside of the well tubing wherein the chamber length is determined or described by;

$$L = \sqrt{\frac{T}{1-T}}\,\frac{cd^2}{4\pi D^2 f} - .75d;$$

and the minimum inside diameter of the chamber is determined or described by $$d = \frac{D}{2c}\sqrt{\frac{1-T}{T}}\left[3\pi Df + \sqrt{\pi f\left(9D^2\pi f + \frac{16Lc}{\sqrt{\frac{1-T}{T}}}\right)}\right];$$

where

L=length of chamber (feet);

d=minimum inside diameter of chamber (feet);

T=fraction of acoustic power transmitted downhole;

c=velocity of acoustic pulse (feet/second);

f=frequency (Herz); and

D=minimum inside diameter of well tubing (feet).

2. A device for enhancing the propagation of acoustic signals through a well tubing according to claim 1 wherein the length of the chamber exceeds the thickness of the tubing wall.

3. A device for enhancing the propagation of acoustic signals through a well tubing according to claim 1 wherein the chamber further comprises at least one curve between its inlet end and exhaust end.

4. A device for enhancing the propagation of acoustic signals through a well tubing according to claim 1 wherein at least one curve in the chamber comprises a 90-degree bend.

5. An apparatus for transmitting acoustic signals downhole through well tubing comprising:

an acoustic transmitter acoustically coupled to the well tubing; and a chamber having an inlet end acoustically coupled to the interior of the well tubing and an exhaust end outside of the well tubing downhole from the acoustic transmitter wherein the chamber length is determined or described by;

$$L=\sqrt{\frac{T}{1-T}}\frac{cd^2}{4\pi D^2 f}-.75d;$$

and the minimum inside diameter of the chamber is determined or described by $$d=\frac{D}{2c}\sqrt{\frac{1-T}{T}}\left[3\pi Df+\sqrt{\pi f\left(9D^2\pi f+\frac{16Lc}{\sqrt{\frac{1-T}{T}}}\right)}\right];$$

where

L=length of chamber (feet);

d=minimum inside diameter of chamber (feet);

T=fraction of acoustic power transmitted downhole;

c=velocity of acoustic pulse (feet/second);

f=frequency (Herz); and

D=minimum inside diameter of well tubing (feet).

6. An apparatus for transmitting acoustic signals downhole through well tubing according to claim 5 wherein the acoustic transmitter comprises a compressed gas gun.

7. An apparatus for transmitting acoustic signals downhole through well tubing according to claim 5 wherein the chamber length exceeds the thickness of the tubing wall.

8. An apparatus for transmitting acoustic signals downhole through well tubing according to claim 5 wherein the chamber further comprises at least one curve between its inlet end and exhaust end.

9. An apparatus for transmitting acoustic signals downhole through well tubing according to claim 8 wherein at least one curve in the chamber consists of a 90 degree bend.

10. An apparatus for activating downhole tools comprising:

an acoustic transmitter acoustically coupled to the well tubing;

a chamber, having an inlet end connected to an orifice and an exhaust end outside of the well tubing, acoustically coupled to the tubing interior downhole from an acoustic source, wherein the chamber length is determined or described by;

$$L=\sqrt{\frac{T}{1-T}}\frac{cd^2}{4\pi D^2 f}-.75d;$$

the minimum inside diameter of the chamber is determined or described by $$d=\frac{D}{2c}\sqrt{\frac{1-T}{T}}\left[3\pi Df+\sqrt{\pi f\left(9D^2\pi f+\frac{16Lc}{\sqrt{\frac{1-T}{T}}}\right)}\right];$$

where

L=length of chamber (feet);

d=minimum inside diameter of chamber (feet);

T=fraction of acoustic power transmitted downhole;

c=velocity of acoustic pulse (feet/second);

f=frequency (Herz);

D=minimum inside diameter of well tubing (feet); and at least one acoustically activated downhole tool.

11. An apparatus for activating downhole tools according to claim 10 wherein the acoustic transmitter comprises a compressed gas gun.

12. An apparatus for activating downhole tools according to claim 10 wherein the chamber length exceeds the thickness of the tubing wall.

13. An apparatus for activating downhole tools according to claim 10 wherein the chamber comprises at least one curve between its inlet end and exhaust end.

14. An apparatus for activating downhole tools according to claim 13 wherein at least one curve in the chamber consists of a 90 degree bend.

15. A method for transmitting acoustic signals through well tubing comprising the steps of:

acoustically connecting an acoustic transmitter to a well tubing;

providing a chamber acoustically coupled to the well tubing interior at a location downhole of the acoustic transmitter wherein the chamber length is determined or described by;

$$L=\sqrt{\frac{T}{1-T}}\frac{cd^2}{4\pi D^2 f}-.75d;$$

the minimum inside diameter of the chamber is determined or described by $$d=\frac{D}{2c}\sqrt{\frac{1-T}{T}}\left[3\pi Df+\sqrt{\pi f\left(9D^2\pi f+\frac{16Lc}{\sqrt{\frac{1-T}{T}}}\right)}\right];$$

where

L=length of chamber (feet);

d=minimum inside diameter of chamber (feet);

T=fraction of acoustic power transmitted downhole;

c=velocity of acoustic pulse (feet/second);

f=frequency (Herz);

D=minimum inside diameter of well tubing (feet); and activating the acoustic transmitter to transmit at least one acoustic signal downhole.

16. A method for transmitting acoustic signals through well tubing according to claim 15 wherein the acoustic transmitter comprises a compressed gas gun.

17. A method for transmitting acoustic signals through well tubing according to claim 15 wherein the chamber length exceeds the thickness of the tubing wall.

18. A method for transmitting acoustic signals through well tubing according to claim 15 further comprising the step of:

receiving the acoustic signal with an acoustic receiver operably connected to a downhole tool.

19. A method for transmitting acoustic signals through well tubing according to claim 15 wherein the chamber further comprises at least one curve between its inlet end and exhaust end.

20. A method for transmitting acoustic signals through well tubing according to claim 19 wherein at least one curve in the chamber consists of a 90 degree bend.

* * * * *